US007560632B1

(12) United States Patent
Lanzel et al.

(10) Patent No.: US 7,560,632 B1
(45) Date of Patent: Jul. 14, 2009

(54) BASS DRUM WITH COMPLIANT RESONANT HEAD

(76) Inventors: Kenneth W. Lanzel, 1413 Charles St., Apt. C, La Crosse, WI (US) 54603; Ryan R. Torgerson, 2431 Wood St., La Crosse, WI (US) 54603

( * ) Notice: Subject to any disclaimer, the term of this patent is extended or adjusted under 35 U.S.C. 154(b) by 480 days.

(21) Appl. No.: 11/487,632

(22) Filed: Jul. 17, 2006

(51) Int. Cl.
*G10D 13/02* (2006.01)

(52) U.S. Cl. ..... 84/411 R

(58) Field of Classification Search ..... 84/411 R, 84/419, 420; 446/318, 319
See application file for complete search history.

(56) References Cited

U.S. PATENT DOCUMENTS 3,553,339 A 1/1971 Dominguez et al.
4,048,895 A 9/1977 May
4,329,905 A 5/1982 Lloyd
4,731,141 A 3/1988 Thirion
4,790,228 A 12/1988 Thirion
5,430,245 A 7/1995 Rogers
5,770,810 A * 6/1998 Lombardi ..... 84/411 R
6,057,499 A 5/2000 Basmadjian
6,121,528 A 9/2000 May
6,212,772 B1 4/2001 Whitmyre et al.
6,982,376 B2 1/2006 Wise
7,256,342 B2 * 8/2007 Hagiwara et al. ..... 84/726

OTHER PUBLICATIONS

GMSDRUMS.COM; News & Events; Printed off Website on Apr. 18, 2006; http://www.gmsdrums.com/NEWS p. 4 of 6.

* cited by examiner

*Primary Examiner*—Kimberly R Lockett
(74) *Attorney, Agent, or Firm*—WWW.BOBHARTER.COM; Robert J. Harter

(57) ABSTRACT

A bass drum comprises a batter head and a resonant head at opposite ends of a cylindrical shell, wherein the resonant head is excitable to produce a lower resonant pitch than what is typically achieved with conventional bass drums. In some embodiments, the resonant head includes the cone of a conventional speaker. The speaker cone, however, is driven by fluid dynamics rather than by electromagnetic force. Moreover, the speaker cone can function without relying on any active electrical pickup coil or transducer being attached to it. In preferred embodiments, the speaker cone is part of a speaker assembly that has an outside diameter that is appreciably smaller than the inside diameter of the shell, wherein an adaptor ring bridges the radial gap between the speaker assembly and the shell. The adaptor ring is particularly useful in retrofitting standard size drum shells with standard size speaker assemblies.

21 Claims, 5 Drawing Sheets

BASS DRUM WITH COMPLIANT RESONANT HEAD

BACKGROUND OF THE INVENTION

1. Field of the Invention

The subject invention generally pertains to drums and more specifically to a dynamic relationship between a drum's batter head and resonant head.

2. Description of Related Art

When electronically sensing and amplifying the sound of a drum, and particularly a bass drum, it can be difficult adjusting a mixing board and/or tuning the drum to achieve a desired low-end thud or pounding effect. It often takes time-consuming trial and error to avoid feedback and minimize ringing, wherein, "ringing" is a thud fading away slowly as opposed to coming to a more abrupt stop.

Consequently, a need exists for a better way of achieving a desired drum sound while minimizing the use of current methods of trial and error.

SUMMARY OF THE INVENTION

It is an object of the invention to create a drum that provides a desirable sound without relying too heavily on current methods of trial and error.

Another object of some embodiments is to lower the resonant pitch of a bass drum.

Another object of some embodiments is to provide a bass drum that comprises a batter head and a resonant head at opposite ends of a generally cylindrical shell, wherein the resonant head has a lower natural frequency than the batter head.

Another object of some embodiments is to make the resonant head of different material than that of the batter head.

Another object of some embodiments is to maintain the batter head in greater radial tension than the resonant head.

Another object of some embodiments is to provide a drum with a batter head and a resonant head such that in response to striking the batter head, the resonant head moves more than the batter head.

Another object of some embodiments is to provide a batter head that has a generally planar surface and a resonant head that has a generally concave external surface.

Another object of some embodiments is to provide a resonant head that is heavier than the batter head.

Another object of some embodiments is to move a resonant head primarily in fluid dynamic reaction to movement of the batter head, thereby not having to rely on some electromagnetic force to do so.

Another object of some embodiments is to provide a resonant head with a desired response without the need for an active electrical pickup coil or transducer being attached to the resonant head or speaker cone thereof.

Another object of some embodiments is to provide a resonant head that is more flexible than the batter head.

Another object of some embodiments is to provide an adaptor ring that fits over the end of a cylindrical drum shell such that a standard-diameter speaker cone can be retrofitted to an appreciably larger diameter drum shell.

Another object of some embodiments is to use a standard drum hoop to help retrofit a conventional bass drum with a speaker cone.

One or more of these and/or other objects of the invention are to provide a drum that includes a batter head and a resonant head, wherein the resonant head has a lower natural frequency than the batter head.

DESCRIPTION OF THE PREFERRED EMBODIMENT

Figure 1:
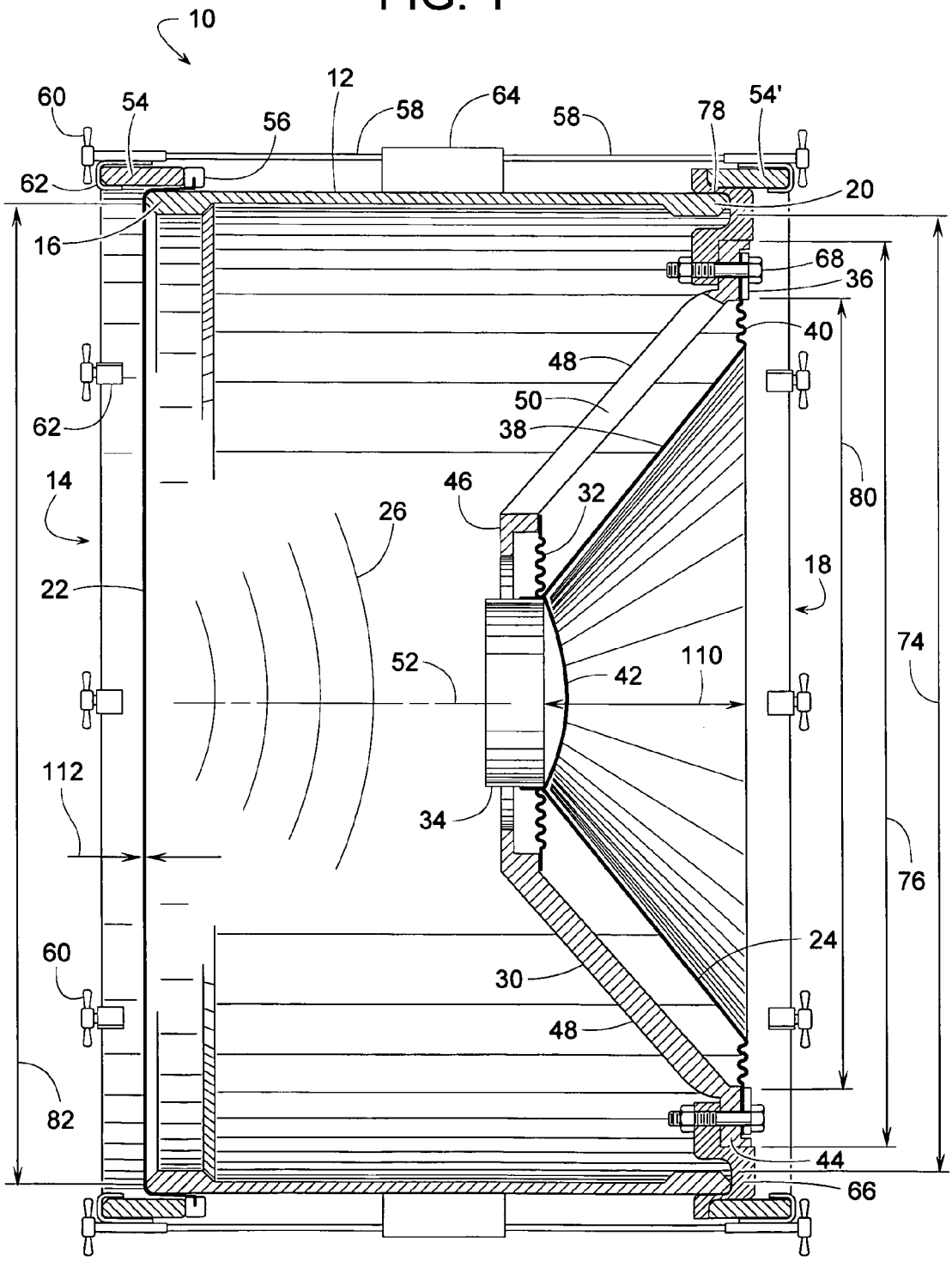
FIG. 1 is a cross-sectional view of a drum taken along line 1-1 of FIG. 2.
Figure 3:
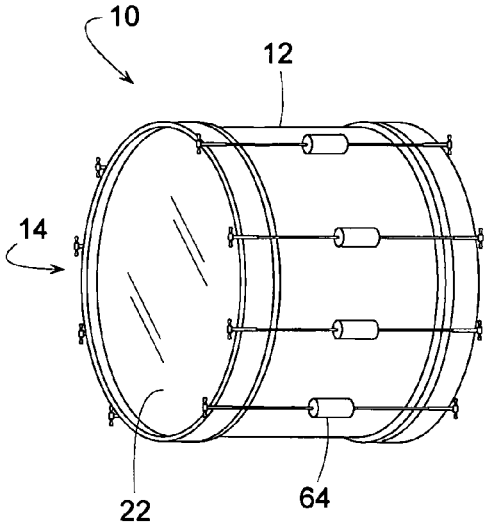
FIG. 3 is a perspective view of the drum in FIG. 2 but showing its batter head (playing head).
Figure 2:
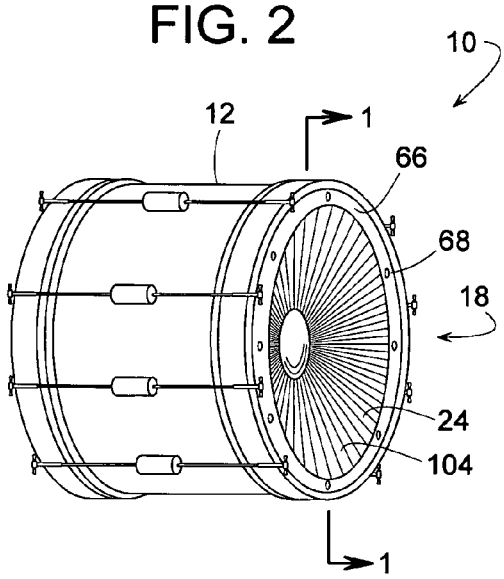
FIG. 2 is a perspective view of a drum showing its resonant head.

Referring to FIGS. 1-3, a bass drum 10 comprises a generally horizontal cylindrical shell 12 with a batter head 14 mounted to an inboard rim 16 of shell 12 and a resonant head 18 installed at an outboard rim 20. Batter head 14 includes a first diaphragm 22, and resonant head 18 includes a second diaphragm 24. Striking diaphragm 22 of batter head 14 creates a sound wave 26 that travels through the interior of shell 12 and excites diaphragm 24 of resonant head 18. Thus, second diaphragm 24 moves primarily in fluid dynamic reaction to movement of first diaphragm 22, rather than being moved by some electromagnetic force. The material, size, radial tension, weight, flexibility, and/or shape of diaphragms 22 and 24 are such that the sounds emanating from diaphragms 22 and 24 are different from each other to create an overall more pleasing sound.

Figure 6:
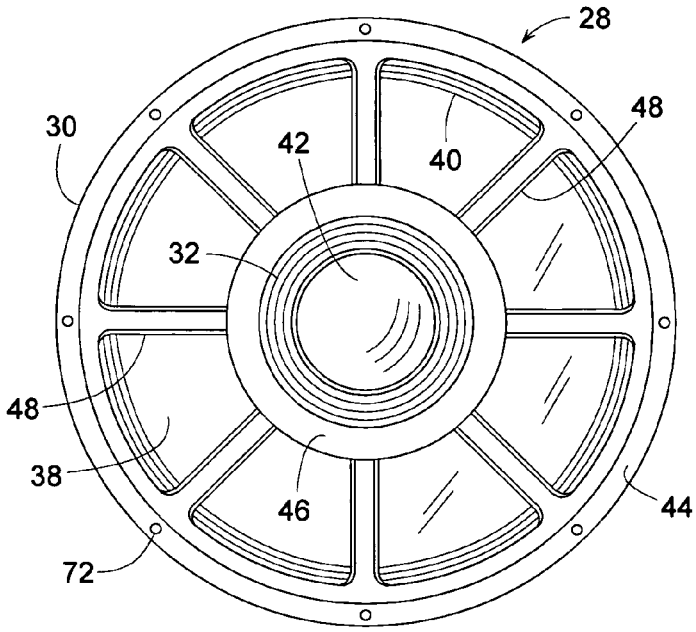
FIG. 6 is a left side view of FIG. 4.
Figure 4:
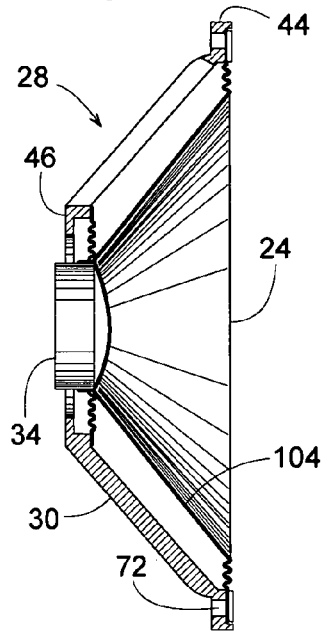
FIG. 4 is a cross-sectional view similar to FIG. 1 but only showing the speaker assembly.
Figure 5:
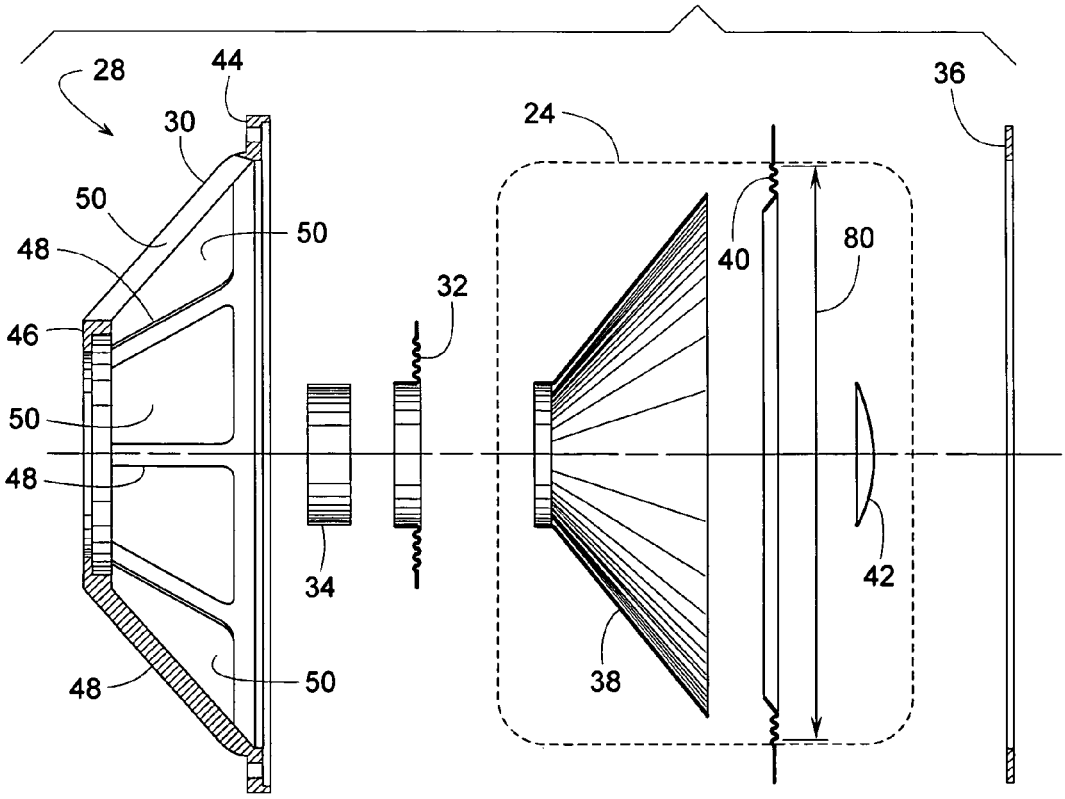
FIG. 5 is an exploded view of the speaker assembly of FIG. 4.

There are various ways of achieving such sound quality from a drum. In a currently preferred embodiment, diaphragm 24 of resonant head 18 is part of a slightly modified, but standard-size speaker assembly 28, as shown in FIGS. 4, 5 and 6. For woofers, standard-size speaker assemblies typically come in nominal outside diameters of 12, 15, 18 and 24 inches.

In this particular example, speaker assembly 28 comprises diaphragm 24, a relatively rigid cast aluminum basket 30 (nominal outside diameter of 18 inches), a spider 32, a bobbin 34 of a voice coil, and a gasket 36. Diaphragm 24 comprises a cone 38, a surround 40, and a dust cap 42, all of which are movable relative to basket 30. Basket 30 includes a larger diameter ring 44 for supporting surround 40 and a smaller diameter ring 46 for supporting spider 32. Rings 44 and 46 are connected by a series of spokes 48 that are circumferentially spaced apart to define openings 50 through which sound waves 26 can pass from diaphragm 22 to 24.

The speaker's original magnet, core, and coil are preferably removed to make speaker assembly 28 lighter. Surround 40 can be a radially corrugated rubber-like elastomer (e.g., polyurethane) that enables the relatively stiff cone 38 and dust cap 42 to vibrate in an axial direction generally parallel to a longitudinal centerline 52 of shell 12. Cone 38 and dust cap 42 can be made of various materials including, but not limited to, polypropylene or paper woven fibers. Spider 32 and bobbin 34 provide cone 38 with radial support as diaphragm 24 vibrates. Bobbin 34 is a thin, lightweight tube, and spider 32 is similar to surround 40.

Figure 7:
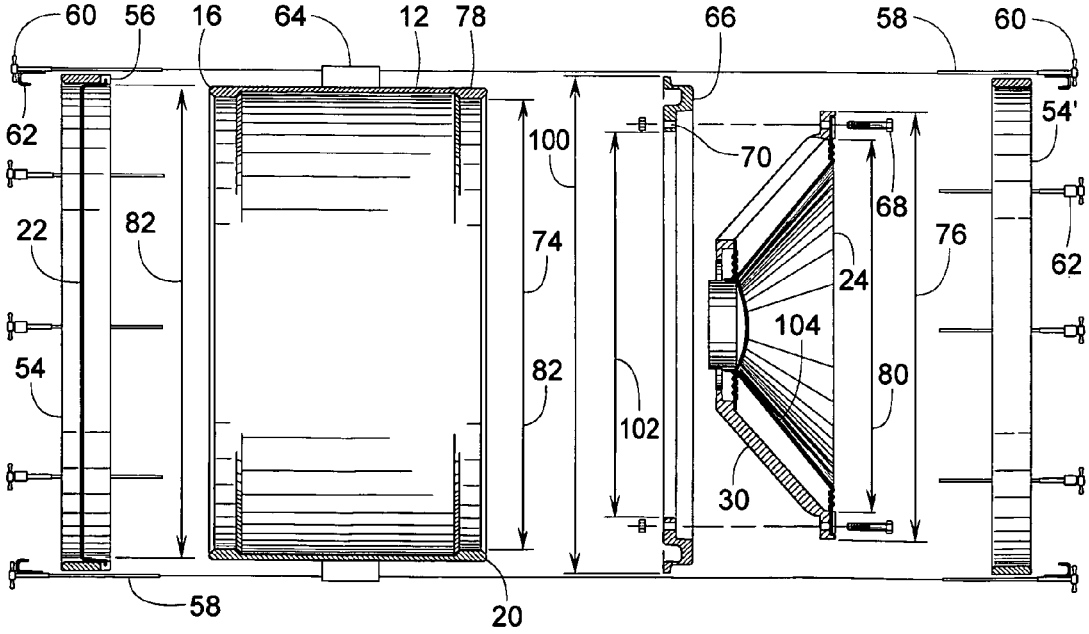
FIG. 7 is an exploded view of the drum of FIGS. 1-3.

First diaphragm 22, on the other hand, can be of a much simpler construction than second diaphragm 24. First diaphragm 22 can be made of conventional batter head material such as MYLAR film (polyester film) or KEVLAR film (polyaromatic amide film), both of which are registered trademarks of Dupont, of Wilmington, Del. Diaphragm 22, as shown in FIG. 7, can be mounted to shell 12 using conventional hardware such as a drum hoop 54 (also known as a tension ring); a head ring 56; and a set of tension rods 58, wing bolts 60, claws 62, and lugs 64—all of which are well known to those of ordinary skill in the art.

Figure 8:
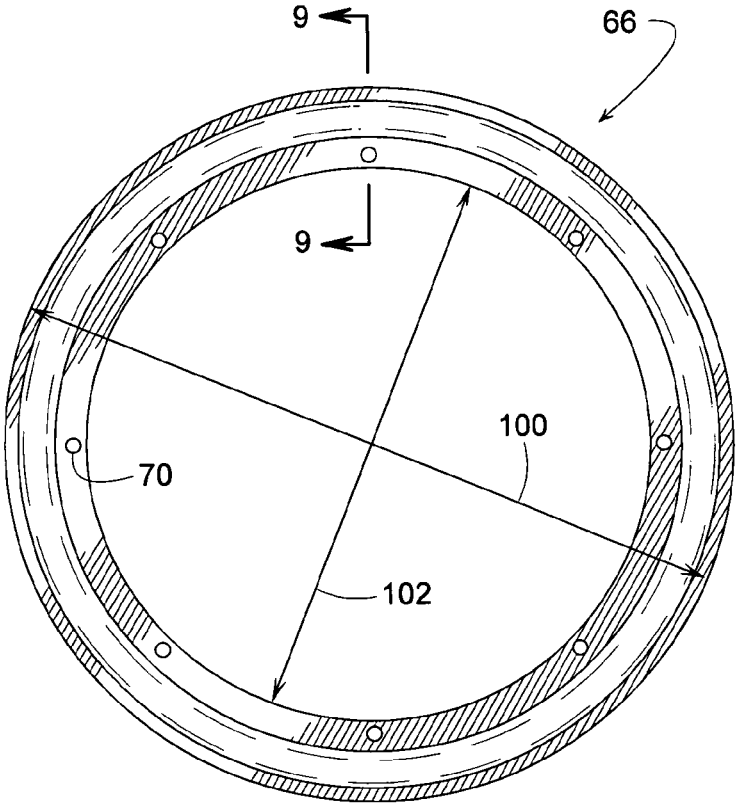
FIG. 8 is a right side view of the adaptor ring shown in FIG. 7.

Mounting diaphragm 24 to outboard rim 20 of shell 12 also employs the use of tension rods 58, wing bolts 60, claws 62, and lugs 64; however, the mounting hardware holds a novel adaptor ring 66 (FIG. 8) instead of the diaphragm or skin of a conventional resonant head. Screws 68 extending through holes 70 and 72 of adaptor 66 and basket 30 respectively can be used for attaching speaker assembly 28 to adaptor ring 66. Adaptor ring 66 bridges a radial gap that would otherwise exist between an inside diameter 74 of shell 12 and a smaller outside diameter 76 of speaker assembly 28 (i.e., outside diameter 76 of basket 30). In some cases, for instance, inside diameter 74 of shell 12 is about 20-inches, while outside diameter 76 is about 18-inches. Other preferred combinations include, but are not limited to, a 15" speaker in an 18" drum, a 15" speaker in a 20" drum, an 18" speaker in a 22" drum, and an 18" speaker in a 24" drum.

Figure 9:
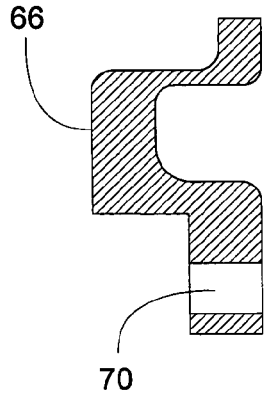
FIG. 9 is a cross-sectional view taken along line 9-9 of FIG. 8.
Figure 10:
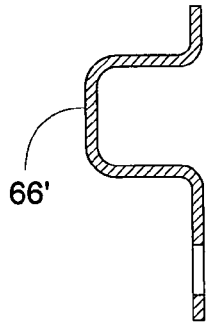
FIG. 10 is a cross-sectional view similar to FIG. 9 but showing an alternate embodiment.

Referring to FIG. 1, in order for adaptor ring 66 to properly engage outboard rim 20 of shell 12, properly engage the outer periphery of speaker assembly 28, and become captured between a drum hoop 54' and a substantially cylindrical outer surface 78 of shell 12, adaptor ring 66 can have a cross-sectional shape as shown in FIG. 9. Such a shape can be cast, machined or molded out of any suitable material. In an alternate embodiment, shown in FIG. 10, a similar adaptor ring 66' can have a generally uniform material thickness, which allows ring 66' to be manufactured by stamping and vacuum forming.

Figure 11:
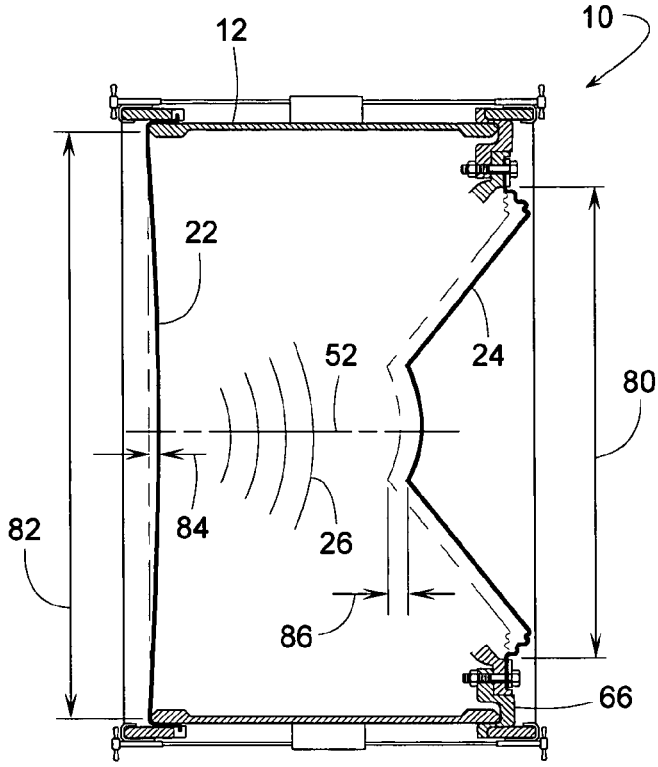
FIG. 11 is a simplified view of FIG. 1 illustrating the dynamics of the drum.

Although it is conceivable that outside diameter 76 of speaker assembly 28 could be approximately equal to inside diameter 74 of shell 12, thereby eliminating the need for adaptor rings 66 or 66', it has been found that having an outside diameter of second diaphragm 80 be appreciably smaller than a diameter 82 of first diaphragm 22 seems to enhance an interesting beneficial phenomenon, which is illustrated in FIG. 11. When diameter 80 is smaller than diameter 82, a slight axial movement 84 of diaphragm 22 can create a larger axial movement 86 of diaphragm 24 for a given, fixed air volume within shell 12 (between diaphragms 22 and 24). This larger axial movement 86 seems to produce the desired "pounding" effect that many drummers try to achieve. This same effect, however, may be achieved by other means.

Figure 12:
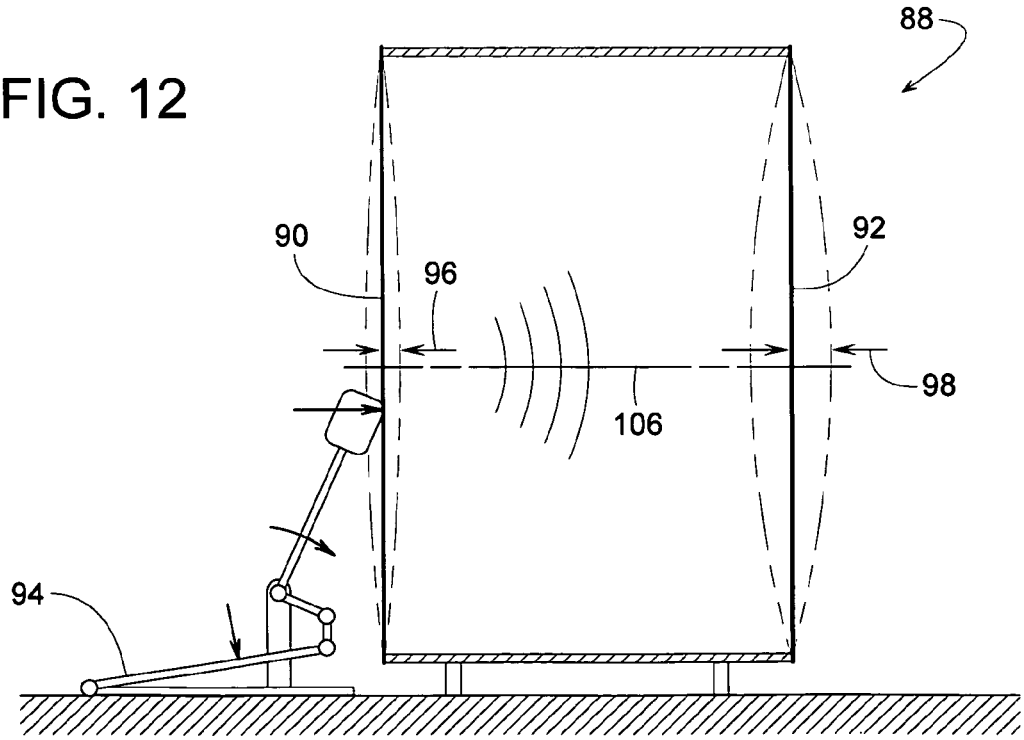
FIG. 12 is a view similar to FIG. 11 but schematically illustrating other embodiments.

In FIG. 12, for instance, a bass drum 88 includes a first diaphragm 90 and a second diaphragm 92 of substantially equal diameter; however, when a bass drum pedal 94 strikes first diaphragm 90 creating a driven displacement 96 in a longitudinal direction parallel to the shell's longitudinal centerline 106, second diaphragm 92 reacts with an axial reactive displacement 98 that is greater than driven displacement 96 of first diaphragm 90. Such a response might occur if second diaphragm 92 has a lower natural frequency of vibration in a direction parallel to centerline 106 than that of first diaphragm 90 due to second diaphragm 92 having more mass, greater flexibility and/or less radial tension than first diaphragm 90. Thus, other conceivable speaker/drum combinations might include, an 18" speaker in an 18" drum or a 24" speaker in a 24" drum.

It should be noted that the exploded view of FIG. 7 illustrates the steps of retrofitting a drum with a speaker assembly by attaching adaptor ring 66 to outboard rim 20 of shell 12, wherein adaptor ring 66 has an outer diameter 100 and an inner diameter 102, outer diameter 100 of adaptor ring 66 is greater than inside diameter 74 of the shell 12, and inner diameter 102 of adaptor ring 66 is less than outside diameter 76 of basket 30; and attaching speaker assembly 28 to adaptor ring 66 such that cone 38 provides drum 10 with a concave surface 104 that faces away from first diaphragm 22. Concave surface 104 is created by having second diaphragm 24 extend an axial length 110 in a longitudinal direction parallel to centerline 52, whereas first diaphragm 22 is generally planar and extends a much less axial length 112 in the longitudinal direction.

It should also be noted that for the purpose of defining a diaphragm's weight or effective outer diameter, a diaphragm (e.g., diaphragms 22, 24, 90 or 92) comprises that part which vibrates or moves more than the shell to which the diaphragm is mounted.

Although the invention is described with reference to a preferred embodiment, it should be appreciated by those of ordinary skill in the art that various modifications are well within the scope of the invention. The scope of the invention, therefore, is to be determined by reference to the following claims.

The invention claimed is:

1. A drum, comprising:

a first diaphragm adapted to be struck;

a second diaphragm; and a shell extending between the first diaphragm and the second diaphragm, the shell is generally cylindrical to define a longitudinal centerline, the first diaphragm has a first natural frequency of vibration in a longitudinal direction parallel to the longitudinal centerline, the second diaphragm has a second natural frequency of vibration in the longitudinal direction, the first natural frequency is higher than the second natural frequency, and the second diaphragm moves primarily in fluid dynamic reaction to movement of the first diaphragm rather than being moved by some electromagnetic force.

2. The drum of claim 1, wherein the first diaphragm undergoes a driven displacement and the second diaphragm undergoes a reactive displacement in response to the first diaphragm being struck, the reactive displacement is greater than the driven displacement.

3. The drum of claim 1, wherein the first diaphragm extends a first axial length in the longitudinal direction, the second diaphragm extends a second axial length in the longitudinal direction, and the second axial length is longer than the first axial length.

4. The drum of claim 1, wherein the second diaphragm is heavier than the first diaphragm.

5. The drum of claim 1, wherein the first diaphragm is more planar than the second diaphragm.

6. The drum of claim 1, wherein the second diaphragm includes a concave surface that faces away from the first diaphragm.

7. The drum of claim 1, further comprising:

an adaptor ring coupling the second diaphragm to the shell, the adaptor ring has an inner diameter that is less than an inside diameter of the shell, and the adaptor ring has an outer diameter that is greater than an outside diameter of the shell.

8. A drum, comprising:

a first diaphragm adapted to be struck;

a second diaphragm; and a shell supporting the first diaphragm and the second diaphragm at opposite ends thereof, the shell is generally cylindrical to define a longitudinal centerline, the first diaphragm undergoes a driven displacement and the second diaphragm undergoes a reactive displacement in response to the first diaphragm being struck, the reactive displacement is greater than the driven displacement, and the second diaphragm moves primarily in fluid dynamic reaction to movement of the first diaphragm rather than being moved by some electromagnetic force.

9. The drum of claim 8, wherein the shell maintains the first diaphragm in greater radial tension than the second diaphragm.

10. The drum of claim 8, wherein the second diaphragm is heavier than the first diaphragm.

11. The drum of claim 8, wherein the first diaphragm is more planar than the second diaphragm.

12. The drum of claim 8, wherein the second diaphragm includes a concave surface that faces away from the first diaphragm.

13. The drum of claim 8, further comprising:

an adaptor ring coupling the second diaphragm to the shell, the adaptor ring has an inner diameter that is less than an inside diameter of the shell, and the adaptor ring has an outer diameter that is greater than an outside diameter of the shell.

14. A method for retrofitting a drum with a speaker assembly, the drum includes a shell that is substantially cylindrical, the speaker assembly includes a cone supported by a basket, the basket has an outside diameter, the shell has an inside diameter that is appreciably larger than the outside diameter of the basket, the shell includes an inboard rim and an outboard rim, the inboard rim supports a first diaphragm adapted to be struck, the method comprising:

attaching an adaptor ring to the outboard rim of the shell, wherein the adaptor ring has an outer diameter and an inner diameter, the outer diameter of the adaptor ring is greater than the inside diameter of the shell, and the inner diameter of the adaptor ring is less than the outside diameter of the basket; and attaching the speaker assembly to the adaptor ring such that the cone provides the drum with a concave surface that faces away from the first diaphragm.

15. The method of claim 14, wherein upon attaching the adaptor ring to the outboard rim of the shell, the adaptor ring overlaps a substantially cylindrical outer surface of the shell.

16. The method of claim 14, wherein the step of attaching the adaptor ring to the outboard rim involves attaching a drum hoop to the shell such that the adaptor ring is captured between the drum hoop and the inboard rim.

17. A drum, comprising:

a first diaphragm adapted to be struck;

a second diaphragm; and a shell extending between the first diaphragm and the second diaphragm, the shell is generally cylindrical to define a longitudinal centerline, the first diaphragm has a first natural frequency of vibration in a longitudinal direction parallel to the longitudinal centerline, the second diaphragm has a second natural frequency of vibration in the longitudinal direction, the first natural frequency is higher than the second natural frequency, and the second diaphragm is more flexible than the first diaphragm in that it takes more force to deflect the first diaphragm than the second diaphragm in the longitudinal direction.

18. The drum of claim 17, wherein the first diaphragm extends a first axial length in the longitudinal direction, the second diaphragm extends a second axial length in the longitudinal direction, and the second axial length is longer than the first axial length.

19. The drum of claim 17, wherein the first diaphragm is more planar than the second diaphragm.

20. The drum of claim 17, wherein the second diaphragm includes a concave surface that faces away from the first diaphragm.

21. The drum of claim 17, further comprising:

an adaptor ring coupling the second diaphragm to the shell, the adaptor ring has an inner diameter that is less than an inside diameter of the shell, and the adaptor ring has an outer diameter that is greater than an outside diameter of the shell.

* * * * *